United States Patent [19]

Yoshida

[11] 4,176,517

[45] Dec. 4, 1979

[54] INTEGRATED CIRCUIT FOR TIMEPIECE

[75] Inventor: Makoto Yoshida, Tokorozawa, Japan

[73] Assignee: Citizen Watch Co. Ltd., Tokyo, Japan

[21] Appl. No.: 818,014

[22] Filed: Jul. 22, 1977

Related U.S. Application Data

[63] Continuation of Ser. No. 617,487, Sep. 29, 1975, abandoned.

[30] Foreign Application Priority Data

Sep. 30, 1974 [JP] Japan ..... 49-112591

[51] Int. Cl.[2] ..... G04C 3/00; G04B 19/30

[52] U.S. Cl. ..... 58/23 R; 58/50 R

[58] Field of Search ..... 58/4 A, 23 R, 23 D, 58/39.5, 50 R, 85.5; 235/92 T, 92 DE; 324/186

[56] References Cited

U.S. PATENT DOCUMENTS

| | | | |
|---|---|---|---|
| 3,540,207 | 11/1970 | Keeler | 58/23 R |
| 3,765,163 | 10/1973 | Levin | 58/85.5 |
| 3,813,533 | 5/1974 | Cone et al. | 58/50 |
| 3,823,546 | 3/1974 | Gortz | 58/125 C |
| 3,854,277 | 12/1974 | Samejima | 58/39.5 |
| 3,866,406 | 2/1975 | Roberts | 58/85.5 |
| 3,871,168 | 3/1975 | Maire | 58/85.5 |
| 3,888,075 | 6/1975 | Wecker | 58/50 R |
| 3,916,612 | 11/1975 | Morokawa et al. | 58/85.5 |
| 3,945,191 | 3/1976 | van Berkum | 58/4 A |
| 3,961,472 | 6/1976 | Riehl | 58/85.5 |
| 3,984,973 | 10/1976 | Ho | 58/50 R |

*Primary Examiner*—Edith S. Jackmon

*Attorney, Agent, or Firm*—Sherman & Shalloway

[57] ABSTRACT

An integrated circuit comprises components for the basic functions of a timepiece and additional components for controlling the operation mode of the basic components. By properly controlling the operation mode of the basic components, the integrated circuit can be applied to two or more types of timepieces, thereby reducing the kinds of the integrated circuits that need to be prepared.

12 Claims, 1 Drawing Figure

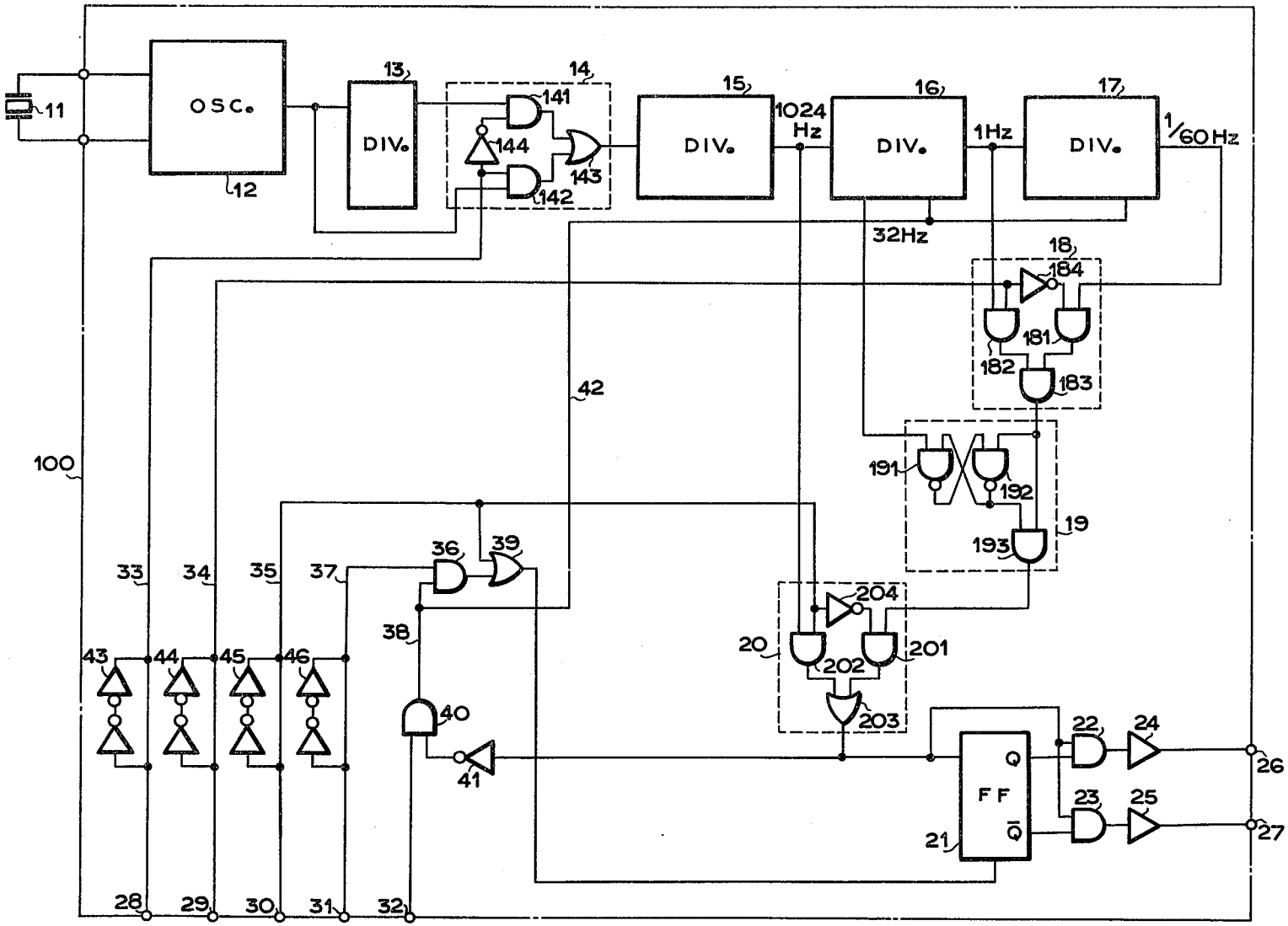
OSC.
DIV.
DIV.
DIV.
DIV.
1/60 Hz
1Hz
32Hz
1024 Hz
FF
Q
Q̄
11
12
13
14
15
16
17
18
19
20
21
22
23
24
25
26
27
28
29
30
31
32
33
34
35
36
37
38
39
40
41
42
43
44
45
46
100
141
142
143
144
181
182
183
184
191
192
193
201
202
203
204

INTEGRATED CIRCUIT FOR TIMEPIECE

This is a continuation of application Ser. No. 617,487, filed Sept. 29, 1975 which is now abandoned.

BACKGROUND OF THE INVENTION

This invention relates to an integrated circuit for use in electronic timepieces and more particularly to an integrated circuit applicable to various types of timepieces.

In the manufacture of electronic timepieces, the integrated circuit is usually designed to be utilized with only for a single type. Accordingly, it is necessary that the same number of types of timepiece of integrated circuits as types of timepiece be prepared. This results in many defects in the manufacture, handling, inspection and setting up, as well as increased cost of the timepiece.

SUMMARY OF THE INVENTION

It is a primary object of this invention to provide an integrated circuit which is applicable to various types of electronic timepieces. This means that the number of types of integrated circuits with respect to the number of types of the timepieces can be reduced.

According to this invention, the common use of the integrated circuit in various types of timepieces is accomplished by providing a plurality of terminals which are connected to a suitable control block in accordance with the particulars of the timepiece to which the integrated circuit is applied.

IN THE DRAWING

The drawing shows a circuit diagram of an integrated circuit embodying this invention.

DESCRIPTION OF THE PREFERRED EMBODIMENT

In the drawing, the integrated circuit 100 embodying this invention includes; an oscillator circuit 12 with a crystal resonance element 11 an auxillary frequency divider 13 for dividing the frequency of the output from the oscillator circuit 12; a select gate 14 comprising a pair of AND-gates 141 and 142, an OR-gate 143 and an inverter 144; and a series of frequency dividers 15, 16 and 17 each of which includes a plurality of flip-flop circuits and together which form a main frequency divider means.

The output of the last stage divider 17 has a frequency of 1/60 Hz (one minute and is lead through select gates 18 and 20 and a shaping circuit 19 to the input of a flip-flop 21. The Q-output of the flip-flop 21 passes through an AND-gate 22 and the $\overline{Q}$-output of the flip-flop through an AND-gate 23 while the AND-gates 22 and 23 are opened by the signal from the select gate 20. The output from the AND-gates 22 and 23 are taken out from terminals 26 and 27 through buffer circuits 24 and 25, respectively, for driving a pulse motor or counter so as to energize a suitable time display. In this embodiment the output of the divider 17 has a frequency of 1/60 Hz.

The output of the oscillator 12 is sent either directly or through the auxillary frequency divider 13 to the divider 15 in accordance with the state of the select gate 14. The divider 15 acts to produce a 1024 Hz signal which is then supplied to the next divider 16 from which two output signals with a frequency of 1 Hz (one second) and of 32 Hz, (1/32 second) respectively, are obtained, the 1 Hz signal being used in the divider 17 to produce 1/60 Hz signal. Either the 1 Hz signal or the 1/60 Hz signal is selected in accordance with the state of the select gate 18 and then is sent to the shaping circuit 19 where the signal is subjected to a wave form shaping to have the desired pulse width, i.e., 15.6 milliseconds by using the 32 Hz signal. The select gate 20 acts to select either the output of the shaping circuit 19 or the 1024 Hz signal and the output signal thereof is used as an input signal of the flip-flop 21.

The integrated circuit 100 described is designed for use in the timepiece with a pulse motor having a pair of input lines. For the purpose of conformity of the integrated circuit with such type of timepiece, a pair of output signals can be obtained from the terminals 26 and 27. The output circuit including the flip-flop 21, AND-gates 22 and 23 and buffer circuits 24 and 25 may be replaced with another type of circuit, the selection being done in accordance with the type of driving circuit for the time display.

The respective element and the connection thereof set forth as above are well known to those skilled in the art of electronic timepiece and the detailed description thereof may be omitted.

The select gate 18 comprises a pair of AND-gates 181 and 182, an OR-gate 183 and an inverter 184 and similarly the select gate 20 is composed of a pair of AND-gates 201 and 202, an OR-gate 203 and an inverter 204. The shaping circuit 19 may comprise a pair of NAND-gates 191 and 192 and an AND-gate 193.

For controlling the select gates 14, 18 and 20, there are provided a plurality of terminals indicated at 28, 29, 30, 31 and 32 in the drawing. The first terminal 28 is connected to one of the inputs of the AND gate 141 through the inverter 144 and to one of the inputs of the AND-gate 142 via a line 33. Similarly, the terminal 29 is connected to one of the inputs of the AND-gate 182 and the input of the inverter 184 of which output is connected to one of the input of the AND-gate 181 through a line 34. In the same manner the third terminal 30 is connected to the input of the inverter 204 through a line 35.

The fourth and fifth terminals 31 and 32 are connected to an AND-gate 36 through lines 37 and 38, respectively, the output of the AND-gate 36 being lead to one of the inputs of an OR-gate 39. The OR-gate 39 acts to supply the signal from the AND-gate 36 or the signal on the line 37 to the reset terminal of the flip-flop 21. An AND-gate 40 is provided in the line 38 and has a first input connected to the terminal 32 and a second input connected to the output of the select gate 20 via an inverter 41. The output signal of the AND-gate 40 is supplied to the reset terminal of the dividers 16 and 17 through a line 42.

The output of the first divider 15 having a frequency of, for example, 1024 Hz is supplied to the input of the AND-gate 202, the output 1 Hz (one second) of the second divider 16 to the AND-gate 182 and the output 1/60 Hz (one minute) of the third divider 17 to the AND-gate 181. Also, the output delivered from the intermediate stage of the divider 16 having a frequency of 32 Hz is connected to the NAND-gate 191.

Inverter rings 43, 44, 45 and 46 respectively connected to the lines 33, 34, 35 and 37 are used as a memory.

In the integrated circuit described, the output level of the AND-OR select gate 14 is determined in accordance with the logical level of the terminal 28. Namely, when the logical level at the terminal 28 is "1," the AND-gate 142 is opened to transmit the output of the oscillator 12 to the divider 15. On the other hand, if the level at the terminal 28 is "0," then the AND-gate 141 allows the output signal of the divider 13 to pass therethrough. Accordingly, it is possible to utilize a crystal oscillator with a resonance frequency either of 32 KHz or of 64 KHz as the element 11.

The terminal 29 is provided for selecting either the 1 Hz (one second) signal and 1/60 Hz signal by controlling the select gate 18. The AND-gate 181 is opened so as to select the 1/60 Hz signal when the logical level at the terminal 29 is "0," while the AND-gate 182 is opened so as to select the 1 Hz signal when the logical level at the terminal 29 is "1." The selected signal is used as an input of the shaping circuit 19.

The terminal 30 is used for an optional function such as for a timing circuit of a timepiece with a liquid crystal display. When the logical level at the terminal 30 is "0," the AND-gate 201 is opened to allow the 1 Hz signal or 1/60 Hz signal to pass therethrough. when the level at the terminal 30 is "1," however, the output of the divider 15 is lead to the flip-flop 21 through the AND-gate 202 and OR-gate 203. At this stage the flip-flop 21 has been reset by the signal supplied through the OR-gate 39, so that the output signal of the flip-flop 21 will appear only at the terminal 27.

The terminal 31 is for selecting the operation modes according to the preference of the user. During the period in which the level at the terminal 30 is kept "0," if the level at the terminal 31 is "0," the reset terminal of the flip-flop 21 is not supplied with a reset signal. While, when there is a level "1" at the terminal 31, the flip-flop 21 is reset.

Lastly, the terminal 32 is provided for resetting the dividers 16 and 17 and also the flip-flop 21 when at the level "1." The AND-gate 40 acts to inhibit the reset signal from the terminal 32, while the output signal appears at the terminal 26 or 27.

In the following table shows the relationship between the level at the terminals 30, 31 and the state of the divider 16, 17 and the flip-flop 21.

| Mode | Level at 31 | Level at 32 | Dividers 16 and 17 | Flip-flop 21 |
|---|---|---|---|---|
| A | 0 | 1 | Reset | Reset |
| B | 0 | 0 | Reset | Not Reset |
| C | 1 | 0 or 1 | | Reset |

From the table, it will be clear that both of the dividers 16 and 17 and the flip-flop 21 are reset of "Mode A," so that the signal would necessarily be given at the predetermined terminal 26 or 27 after one second from the release of the terminal 32. When the negative flip-flop is used as the flip-flop 21, the output definitely appears at the terminal 27.

In "Mode B," the flip-flop 21 is kept at the same state as before the resetting operation, because the flip-flop is not reset, and the output is always given at the opposite terminal 26 or 27 to that which is given the output at the time of resetting, after one second.

Furthermore, in "mode C," the flip-flop 21 is kept at the reset state and the output of the divider having a frequency of 1024 Hz will appear at the terminal 32.

In summary, the terminals 28 through 31 have the following functions:

Terminal 28: Selects the frequency-dividing ratio based on the crystal resonance element used.

Terminal 29: Selects either the second signal or minute signal as the output.

Terminal 30: Determines whether or not selecting a timing signal for liquid crystal display as the output.

Terminal 31: Turns over the resetting mode.

The above functions can be selected in any combination in accordance with the require in the manufacture of timepieces.

One of the important features of this invention is that, in addition to providing the components for the basic functions which include the crystal resonance element 11, oscillating circuit 12, dividers 13, 15, 16 and 17, shaping circuit 19 and output circuit, the invention provides AND-OR select gates and the control terminals therefor, as the components for the additional functions, thereby making it possible to utilize the integrated circuit with at least two types of timepieces. In fact, the integrated circuit described above can be utilized with at least nine types of timepiece.

The components for the additional functions comprise only an extremely small proportion of the total number of components of the timepiece, so that the increase in cost of the timepiece is negligibly small. In addition, the use of an integrated circuit applicable to various kinds of timepiece is of considerable merit in mass production, ease of inspection, administration and service after sale, and so forth.

What is claimed is:

1. A single integrated circuit for use in alternative assembly of a plurality of types of electronic timepieces, said integrated circuit comprising:
   - a set of first electronic components providing basic functions which are common to the operation of each type of timepiece,
   - a set of second electronic components providing basic functions, those functions common to the operation of at least one but not all of the plurality of types of timepieces,
   - a control for operating selected ones of said second electronic components to thereby match said circuit to a selected type of timepiece including an oscillator having an output frequency for use in driving a pulse motor of the timepiece, the set of first electronic components including a main frequency divider means having first and second stages for reducing the frequency of the oscillator before applying the output frequency of the oscilator to the pulse motor; reset means included with said control circuit for performing a reset function on the frequency divider means; and terminals included in said control circuit for providing two inputs which selectively cause the reset means to reset the first and second stages of the frequency divider means by selectively combining binary values "1" and "0" as inputs on said terminals.

2. A single integrated circuit for installation in alternative assembly of any of a plurality of types of electronic timepieces, said integrated circuit comprising:
   - a single chip including
   - a set of first electronic components providing a plurality of basic functions which are inclusive of the operations of each of the several types of timepiece,
   - a set of second electronic components for selecting among the basic functions those functions common to the operation of at least one but not all of the plurality of types of timepieces, a control circuit for operating selected ones of said second electronic components to thereby match said circuit to a selected type of said plurality of timepiece types, and a memory for storing a signal which selects the second electronic components which are coupled to the set of first electronic components, wherein the first set of electronic components includes an oscillator and a main frequency divider means connected to the oscillator; wherein the second set of electronic components include an auxiliary frequency divider and a selecting logic circuit connected between the oscillator and the main frequency divider means; wherein the selecting logic circuit has an output to the main frequency divider means, an input from the auxiliary frequency divider, an input directly from the oscillator, and an input from the control circuit which switches the logic of the select circuit in accordance with a logic valve on a terminal of the control circuit to cause the select circuit to select the input from the oscillator or the input from the auxiliary frequency divider.

3. A single integrated circuit for use in alternative assembly of a plurality of types of electronic timepieces, said integrated circuit comprising:

a set of first electronic components providing basic functions which are common to the operation of each type of timepiece, a set of second electronic components providing basic functions, those functions common to the operation of at least one but not all of the plurality of types of timepieces, a control circuit for operating selected ones of said second electronic components to thereby match said circuit to a selected type of timepiece including an oscillator having an output frequency for use in driving a pulse motor of the timepiece, the set of first electronic components including a main frequency divider means having first and second stages for reducing the output frequency of the oscillator before applying the output frequency of the oscillator to the pulse motor; the first stage of the main frequency divider has a frequency of 1 Hz and the second stage of the frequency divider has a lower frequency of less than 1 Hz; wherein said set of second electronic components includes a select circuit which receives 1 Hz and said lower frequency signals from the first and second stages of the frequency divider and which further includes a selecting logic circuit for selecting between the 1 Hz and said lower frequency signals, wherein the control circuit includes a terminal connected to the select circuit for applying a binary signal to the select circuit so as to select between the 1 Hz and said lower frequency signals by designating the binary values "1" and "0," and wherein the set of second components further includes:

an auxiliary frequency divider connected to the oscillator, and another selecting logic circuit connected to the main frequency divider and having an input from the auxiliary frequency divider, an input directly from the oscillator and an input from the control circuit;

wherein the control circuit includes:

a terminal connected to the input to the other selecting logic circuit for applying a binary signal to the other selecting circuit so as to select between the input directly from the oscillator and the input from the auxiliary frequency divider.

4. A single integrated circuit for use in alternative assembly of a plurality of types of electronic timepieces, said integrated circuit comprising:

a set of first electronic components providing basic functions which are common to the operation of each type of timepiece, a set of second electronic components for selecting among the basic functions those functions common to the operation of at least one but not all of the plurality of types of timepieces, a control circuit for operating selected ones of said second electronic components to thereby match said circuit to a selected type of timepiece, the types of timepieces including timepieces having displays which are driving by pulse motor and displays which are electro-optical, the set of first electronic components including a frequency divider means which is arranged in at least two stages, the first of which has a given output signal and the other of which has a signal with output frequency lower than said given output signal, said integrated circuit further comprising:

a select logic circuit included with said set of second components wherein said select circuit has a first input of said given output signal from the first frequency divider stage, an input from the other frequency divider stage, and an input from the control circuit which switches the logic of the select circuit in accordance with a logic value on a terminal of the control circuit to cause the select circuit to select said first input signal, if the integrated circuit is used with a timepiece having an electro-optical display, and to select the other signal if the timepiece has a display driven by a pulse motor wherein the other frequency divider stage provides an input to the select logic circuit of 1 Hz for driving a pulse motor and a display driven by the pulse motor at a rate of one step per second.

5. A single integrated circuit for use in alternative assembly of a plurality of types of electronic timepieces, said integrated circuit comprising:

a set of first electronic components providing basic functions which are common to the operation of each type of timepiece, a set of second electronic components for selecting among the basic functions those functions common to the operation of at least one but not all of the plurality of types of timepieces, a control circuit for operating selected ones of said second electronic components to thereby match said circuit to a selected type of timepiece, the types of timepieces including timepieces having displays which are driven by pulse motor and displays which are electro-optical, the set of first electronic components including a frequency divider means which is arranged in at least two stages, the first of which has a given output signal and the other of which has a signal with output frequency lower than said given output signal, said integrated circuit further comprising:

a select logic circuit included with said set of second components wherein said select circuit has a first input of said given output signal from the first frequency divider stage, an input from the other frequency divider stage, and an input from the control circuit which switches the logic of the select circuit in accordance with a logic value on a terminal of the control circuit to cause the select circuit to select said first input signal, if the integrated circuit is used with a timepiece having an electro-optical display, and to select the other signal if the timepiece has a display driven by a pulse motor, wherein the other frequency divider stage provides an input to the select logic circuit of 1/60 Hz for driving a pulse motor and a display driven by the pulse motor at a rate of one step per minute.

6. A single integrated circuit for use in alternative assembly of a plurality of types of electronic timepieces, said integrated circuit comprising:

a set of first electronic components providing basic functions which are common to the operation of each type of timepiece, a set of second electronic components for selecting among the basic functions those functions common to the operation of at least one but not all of the plurality of types of timepieces, a control circuit for operating selected ones of said second electronic components to thereby match said circuit to a selected type of timepiece, the types of timepieces including timepieces having displays which are driven by pulse motor and displays which are electro-optical, the set of first electronic components including a frequency divider means which is arranged in at least two stages, the first of which has a given output signal and the other of which has a signal with output frequency lower than said given output signal, said integrated circuit further comprising:

a select logic circuit included with said set of second components wherein said select circuit has a first input of said given output signal from the first frequency divider stage, an input from the other frequency divider stage, and an input from the control circuit which switches the logic of the select circuit in accordance with a logic value on a terminal of the control circuit to cause the select circuit to select said first input signal, if the integrated circuit is used with a timepiece having an electro-optical display, and to select the other signal if the timepiece has a display driven by a pulse motor, wherein the frequency divider means has at least three stages; wherein the stages delivering a signal other than said first input produce signals of 1 Hz and 1/60 Hz which are applied through another select logic circuit to the first mentioned select logic circuit, wherein the other select logic circuit is connected to a logic terminal in the control circuit which switches the other select logic circuit to select either the 1 Hz signal or 1/60 Hz signal for application to the first mentioned select logic circuit, so that if the first mentioned select logic circuit is switched to select the pulse-motor driven display, the display may index at a rate of one step per minute or one step per second.

7. A single integrated circuit for use in alternative assembly of a plurality of types of electronic timepieces, said integrated circuit comprising:

a set of first electronic components providing basic functions which are common to the operation of each type of timepiece, a set of second electronic components providing basic functions, those functions common to the operation of at least one but not all of the plurality of types of timepieces, a control circuit for operating selected ones of said second electronic components to thereby match said circuit to a selected type of timepiece including an oscillator having an output frequency for use in driving a pulse motor of the timepiece, the set of first electronic components including a main frequency divider means having first and second stages for reducing the output frequency of the oscillator before applying the output frequency of the oscillator to the pulse motor; the first stage of the main frequency divider has a frequency of 1 Hz and the second stage of the frequency divider has a lower frequency of less than 1 Hz; wherein said set of second electronic components includes a select circuit which receives 1 Hz and said lower frequency signals from the first and second stages of the frequency divider and which further includes a selecting logic circuit for selecting between the 1 Hz and said lower frequency, wherein the control circuit includes a terminal connected to the select circuit for applying a binary signal to the select circuit so as to select between the 1 Hz and said lower frequency signals by designating the binary values "1" and "0," and wherein said lower frequency is 1/60 Hz.

8. A single integrated circuit for use in alternative assembly of a plurality of types of electronic timepieces, said integrated circuit comprising:

a set of first electronic components providing basic functions which are common to the operation of each type of timepiece, a set of second electronic components for selecting among the basic functions those functions common to the operation of at least one but not all of the plurality of types of timepieces, a control circuit for operating selected ones of said second electronic components to thereby match said circuit to a selected type of timepiece, the types of timepieces including timepieces having displays which are driven by pulse motor and displays which are electro-optical, the set of first electronic components including a frequency divider means which is arranged in at least two stages, the first of which has a given output signal and the other of which has a signal with output frequency lower than said given output signal, said integrated circuit further comprising:

a select logic circuit included with said set of second components wherein said select circuit has a first input of said given output signal from the first frequency divider stage, an input from the other frequency divider stage, and an input from the control circuit which switches the logic of the select circuit in accordance with a logic value on a terminal of the control circuit to cause the select circuit to select said first input signal, if the integrated circuit is used with a timepiece having an electro-optical display, and to select the other signal if the timepiece has a display driven by a pulse motor, wherein said given output signal is 1024 Hz.

9. A single integrated circuit for use in alternative assembly of a plurality of types of electronic timepieces, said integrated circuit comprising:

a set of first electronic components providing basic functions which are common to the operation of each type of timepiece, a set of second electronic components providing basic functions, those functions common to the operation of at least one but not all of the plurality of types of timepieces, a control circuit for operating selected ones of said second electronic components to thereby match said circuit to a selected type of timepiece including an oscillator having an output frequency for use in driving a pulse motor of the timepiece, the set of first electronic components including a main frequency divider means having first and second stages for reducing the output frequency of the oscillator before applying the output frequency of the oscillator to the pulse motor; the first stage of the main frequency divider has a frequency of 1 Hz and the second stage of the frequency divider has a lower frequency of less than 1 Hz; wherein said set of second electronic components includes a select circuit which receives 1 Hz and said lower frequency signals from the first and second stages of the frequency divider and which further includes a selecting logic circuit for selecting between the 1 Hz and said lower frequency signals, wherein the control circuit includes a terminal connected to the select circuit for applying a binary signal to the select circuit so as to select between the 1 Hz and said lower frequency signals by designating the binary values "1" and "0," and wherein said control circuit further includes a memory for memorizing said binary signal.

10. A single integrated circuit for use in alternative assembly of a plurality of types of electronic timepieces, said integrated circuit comprising:

a set of first electronic components providing basic functions which are common to the operation of each type of timepiece, a set of second electronic components for selecting among the basic functions those functions common to the operation of at least one but not all of the plurality of types of timepieces, a control circuit for operating selected ones of said second electronic components to thereby match said circuit to a selected type of timepiece, the types of timepieces including timepieces having displays which are driven by pulse motor and displays which are electro-optical, the set of first electronic components including a frequency divider means which is arranged in at least two stages, the first of which has a given output signal and the other of which has a signal with output frequency lower than said given output signal, said integrated circuit further comprising:

a select logic circuit included with said set of second components wherein said select circuit has a first input of said given output signal from the first frequency divider stage, an input from the other frequency divider stage, and an input from the control circuit which switches the logic of the select circuit in accordance with a logic value on a terminal of the control circuit to cause the select circuit to select said first input signal, if the integrated circuit is used with a timepiece having an electro-optical diplay, and to select the other signal if the timepiece has a display driven by a pulse motor, wherein said control circuit further includes a memory for memorizing said logic value.

11. A single integrated circuit for use in alternative assembly of a plurality of types of electronic timepieces, said integrated circuit comprising:

a set of first electronic components providing basic functions which are common to the operation of each type of timepiece, a set of second electronic components providing basic functions, those functions common to the operation of at least one but not all of the plurality of types of timepieces, a control circuit for operating selected ones of said second electronic components to thereby match said circuit to a selected type of timepiece including an oscillator having an output frequency for use in driving a pulse motor of the timepiece, the set of first electronic components including a main frequency divider means having first and second stages for reducing the output frequency of the oscillator before applying the output frequency of the oscillator to the pulse motor; the first stage of the main frequency divider has a frequency of 1 Hz and the second stage of the frequency divider has a lower frequency of less than 1 Hz; wherein said set of second electronic components includes a select circuit which receives 1 Hz and said lower frequency signals from the first and second stages of the frequency divider and which further includes a selecting logic circuit for selecting between the 1 Hz and said lower frequency signals, wherein the control circuit includes a terminal connected to the select circuit for applying a binary signal to the select circuit so as to select between the 1 Hz and said lower frequency signals by designating the binary values "1" and "0," and wherein the second stage of the frequency divider has a frequency hich is greater than 1/60 Hz.

12. A single integrated circuit for use in alternative assembly of a plurality of types of electronic timepieces, said integrated circuit comprising:

a set of first electronic components providing basic functions which are common to the operation of each type of timepiece, a set of second electronic components for selecting among the basic functions hose functions common to the operation of at least one but not all of the plurality of types of timepieces, a control circuit for operating selected ones of said second electronic components to thereby match said circuit to a selected type of timepiece, the types of timepieces including timepieces having displays which are driven by pulse motor and displays which are electro-optical, the set of first electronic components including a frequency divider means which is arranged in at least two stages, the first of which has a given output signal and the other of which has a signal with output frequency lower than said given output signal, said integrated circuit further comprising:

a select logic circuit included with said set of second components wherein said select circuit has a first input of said given output signal from the first frequency divider stage, an input from the other frequency divider stage, and an input from the control circuit which switches the logic of the select circuit in accordance with a logic value on a terminal of the control circuit to cause the select circuit to select said first input signal, if the integrated circuit is used with a timepiece having an electro-optical display, and to select the other signal if the timepiece has a display driven by a pulse motor, wherein the given output signal of the first stage of the frequency divider means is equal to or greater than 1024 Hz and the output frequency of the signal of the second stage of the frequency divider means is between 1/60 Hz and 1024 Hz.

* * * * *

UNITED STATES PATENT AND TRADEMARK OFFICE

CERTIFICATE OF CORRECTION

PATENT NO. : 4,176,517

DATED : December 4, 1979

INVENTOR(S) : Makoto Yoshida

It is certified that error appears in the above-identified patent and that said Letters Patent are hereby corrected as shown below:

Claim 1, line 42, after "control" insert -- circuit --.

Signed and Sealed this

*Seventeenth* Day of *June 1980*

[SEAL]

*Attest:*

SIDNEY A. DIAMOND

*Attesting Officer*

*Commissioner of Patents and Trademarks*